United States Patent [19]

Simeth et al.

[11] 4,404,905

[45] Sep. 20, 1983

[54] VERSO PRINTING UNIT IN THE DELIVERY OF A SHEET-FED ROTARY PRINTING PRESS

[75] Inventors: Claus Simeth, Offenbach am Main; Oskar Liebert, Westheim; Klaus Theilacker, Friedberg, all of Fed. Rep. of Germany

[73] Assignee: M.A.N.-Roland Druckmaschinen Aktiengesellschaft, Fed. Rep. of Germany

[21] Appl. No.: 395,141

[22] Filed: Jul. 2, 1982

Related U.S. Application Data

[63] Continuation-in-part of Ser. No. 374,149, May 3, 1982, abandoned.

[30] Foreign Application Priority Data

May 6, 1981 [DE] Fed. Rep. of Germany ..... 3117856

[51] Int. Cl.[3] ..... B41F 5/16

[52] U.S. Cl. ..... 101/183; 101/231; 101/246; 271/277; 271/204

[58] Field of Search ..... 101/183, 181, 177, 217, 101/229, 231, 246; 271/228, 246, 272, 273, 277

[56] References Cited

U.S. PATENT DOCUMENTS

| | | | |
|---|---|---|---|
| 1,348,253 | 8/1920 | Upham | 101/231 |
| 3,826,486 | 7/1974 | Abendroth | 271/204 |
| 3,827,688 | 8/1974 | Luffy et al. | 271/204 |
| 3,926,118 | 12/1975 | Preuss | 101/246 |
| 4,081,723 | 3/1978 | Vetter et al. | 101/181 X |
| 4,214,526 | 7/1980 | Jeschke | 101/183 |

FOREIGN PATENT DOCUMENTS

| | | |
|---|---|---|
| 541683 | 1/1932 | Fed. Rep. of Germany . |
| 881043 | 6/1953 | Fed. Rep. of Germany . |
| 2013686 | 12/1971 | Fed. Rep. of Germany . |
| 2111049 | 9/1973 | Fed. Rep. of Germany . |
| 1930317 | 12/1978 | Fed. Rep. of Germany . |

*Primary Examiner*—E. H. Eickholt

*Attorney, Agent, or Firm*—Leydig, Voit, Osann, Mayer & Holt, Ltd.

[57] ABSTRACT

An apparatus for printing the back, or "verso", side of a sheet being fed from a sheet-fed printing press into a delivery unit, the sheets being conveyed by an endless loop conveyor made up of a pair of laterally spaced conveyor chains. Cross members extend between the chains at regular intervals and carry grippers for gripping the leading edge of a sheet. The chains are guided so that they form a delivery run and a return run spaced apart and generally parallel to one another. An impression cylinder is journalled between the runs having an axial length which is shorter than the lateral spacing between the chains. A blanket cylinder is journalled outside of the delivery run in rolling engagement with the impression cylinder. A plate cylinder having inking and dampening systems is in rolling engagement with the blanket cylinder. The impression and blanket cylinders have mating longitudinal grooves of a size sufficient to provide free passage for the cross members and grippers. The spacing between the successive cross members is equal to the circumference of the cylinders. The cylinders are driven in synchronism with the conveyor chain so that a sheet passing on the grippers is engaged between the impression and blanket cylinders for application of a printed impression to the sheet. The speed of the conveyor is less than press speed in a predetermined ratio. The cylinders are all of the same diameter, which diameter is less than the diameter of the cylinders in the associated press unit in the same ratio.

7 Claims, 5 Drawing Figures

DRIVE
GRIPPER RELEASE
CD
L
P
1a
1a

VERSO PRINTING UNIT IN THE DELIVERY OF A SHEET-FED ROTARY PRINTING PRESS

This is a continuation-in-part of application Ser. No. 374,149, filed May 3, 1982 and now abandoned.

The usual sheet-fed rotary lithographic press is provided with cylinders for making one or more printed impressions on one side of the sheet only, referred to as "recto" printing. Where it is desired to print on both sides of the sheet, it is customary to provide a second printing unit which may be connected to the first by a conveyor, with the printing on the back side of the sheet being referred to as "verso" printing. After the sheet is printed, it is conveyed by a suitable conveyor to a delivery unit where the sheets are stacked.

It has long been the desire of a printer to avoid the expense and complexity of an additional complete printing unit by providing means in the delivery unit for printing on the verso side. This is done, for example, in German Pat. No. 2,013,686 which was laid open on Dec. 16, 1971. However, the verso printing scheme there shown is relatively complex and costly. An impression cylinder is employed to act as a transfer drum, and an intermediate drum is also required, making a total of five additional cylinders or drums for printing on the verso side. Moreover, the printed sheet is subject to two additional gripper closing operations during conveyance. As a result of the investment required and inherent service problems, the arrangement is not widely used.

It is, accordingly, an object of the present invention to provide means in the delivery unit of a printing press for printing on the verso side of a sheet as the sheet is being conveyed by the regular grippers of the conveyor. It is a related object to provide means for achieving verso printing in a delivery unit which does not require use of auxiliary transfers by transfer drums or the like and in which the sheet is printed on the verso side as it follows a straight line conveyance path. It is another object to provide means for printing the verso side of the sheet in the delivery unit which is installed in space already available in the delivery unit and which requires but three cylinders, plate, blanket and impression.

It is accordingly an object of the invention to provide means for printing on the verso side of the sheet which uses a minimum parts, which is of simple construction, easily installed and serviced, with convenient access, and which is capable of being economically installed in new delivery units or, on a retrofit basis, in units already in the field, to provide the advantages of verso printing at lowest possible cost.

It is still another object of the present invention to provide a device of the type described which is highly compact, a device in which both the delivery run and return run of the conveyor have free passage through a groove in the impression cylinder without necessity for any special synchronizing means, and in which the cylinders are so arranged as to facilitate impression adjustment and throw-off.

Other objects and advantages of the invention will become apparent upon reading the attached detailed description and upon reference to the drawings in which:

FIG. 1 is an elevational view, somewhat diagrammatic, of a delivery unit for a printing press incorporating provision for verso printing in accordance with the present invention.

FIG. 1*a* is a partial top view of the delivery unit shown in FIG. 1 looking along the line 1*a*—1*a* therein.

FIG. 1*b* is a fragment showing free passage of cross member and grippers in the return run.

While the invention has been described in connection with a preferred embodiment, it will be understood that we do not intend to be limited to the particular embodiment shown but intend, on the contrary, to cover the various alternative and equivalent constructions included within the spirit and scope of the appended claims.

Figures 1, 1A, 1B:
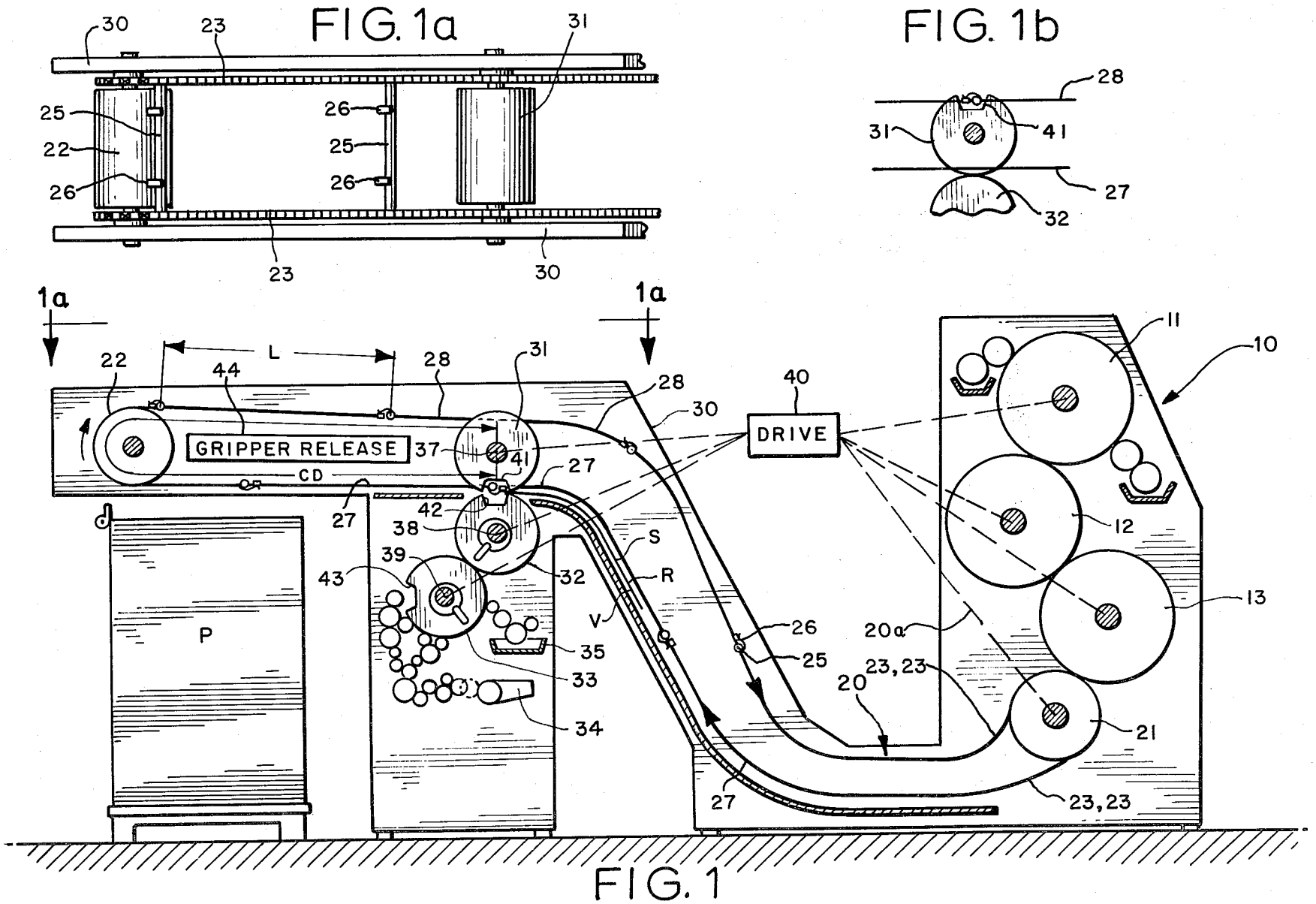
Figure 2:
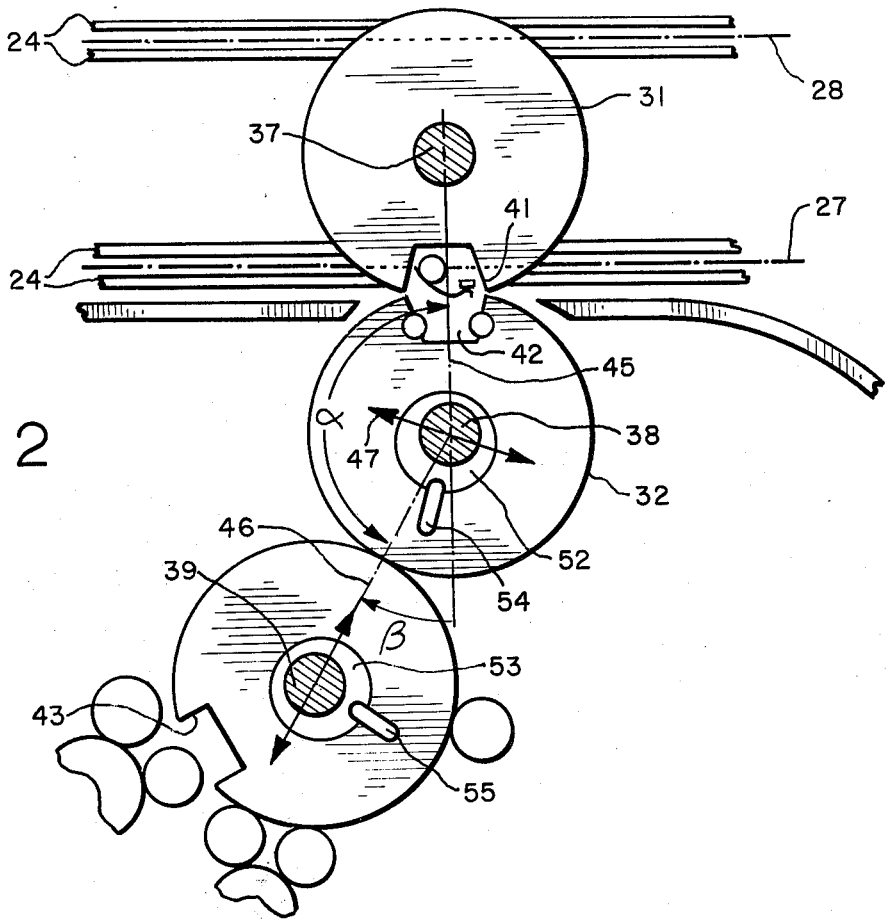
FIG. 2 is an enlarged view of a portion of FIG. 1.

Turning now to FIG. 1 of the drawings there is shown, in diagrammatic form, a lithographic printing press unit 10 having the usual plate cylinder 11, blanket cylinder 12 and impression cylinder 13. This unit either acting alone or in tandem with preceding press units achieves recto printing only, that is, printing on one side of the sheet, the sheet being indicated at S. The printing unit 10 discharges into a conveyor 20 having an input drum 21 and an output drum 22. The conveyor is formed of a pair of laterally spaced closed loops of conveyor chain 23 which are trained around sprockets associated with the drums, the loops of chain being guided between the drums on guide rails 24 (FIG. 2). Extending between the chains 23 are cross members 25 which are spaced at equal intervals along the entire length of the chain, the cross members carrying pairs of grippers 26 which grip and transport the leading edges of successive sheets. The conveyor is divided, by the drums at each end, into a delivery run 27 leading from the press unit to the pile P and an idle or return run 28. The front, or recto, and the back, or verso, sides of the sheet are indicated in the drawing by the letters R and V respectively.

In accordance with the present invention an impression cylinder is journalled in the frame 30 of the delivery unit between the runs and having an axial length which is shorter than the lateral spacing between the chains. A blanket cylinder journalled in the frame outside of the delivery run is in rolling engagement with the impression cylinder. A plate cylinder having the usual inking and dampening systems runs in rolling engagement with the blanket cylinder. The circumference of the cylinders is equal to the spacing between successive cross members, and the impression cylinder has a longitudinal groove of sufficient size to provide free passage for the cross members and their associated grippers. The cylinders are driven in synchronism with the conveyor chains so that a sheet passing on the grippers is engaged between the impression and blanket cylinders for application of a printed impression to the sheet.

Thus, referring to FIGS. 1 and 2, an impression cylinder 31 is journalled in the frame 30 of the delivery unit between the runs 27, 28, the impression cylinder having an axial length which is shorter than the lateral spacing between the chains. In rolling engagement with the impression cylinder is a blanket cylinder 32 journalled in the frame outside of the delivery run 27. Cooperating with the blanket cylinder is a plate cylinder 33 having an inking system 34 and a source of water 35. The cylinders have respective shafts 37, 38 and 39. The circumference of all the cylinders is equal to the spacing L of the successive grippers and cross members. The cylinders and conveyor have a common drive 40.

The conveyor drive connection 20*a* which drives the conveyor 20 is such that the surface speed of the conveyor is less than press speed in a predetermined ratio. The auxiliary printing cylinders 31, 32 and 33 have a diameter and surface speed which is less than the diameter and surface speed of the cylinders in the associated press unit 10 in the same ratio.

In carrying out the invention the impression cylinder 31 is provided with a groove 41 large enough to provide free passage for the cross members 25 and grippers 26 thereon in the delivery run 27. The blanket cylinder 32 has a mating groove 32 and the plate cylinder 33 preferably has a groove 43 of similar span.

Thus, in operation, with the cylinders 31–33 driven in synchronism with the conveyor chains, the cross members and grippers pass freely between the cylinders 31, 32, and a sheet S, passing on the grippers, is engaged between the impression and blanket cylinders for application of a printed impression to the back side (underside) of the sheet. When the sheet, now printed on both sides, leaves the cylinders 31, 32 it passes to a position above the delivery pile P where the grippers are released by an automatic gripper release mechanism 44 so that the sheet is deposited on the pile. The grippers thus return empty over the upper, or return, run 28 of the conveyor.

In accordance with one of the aspects of the invention, the spacing between the delivery run 27 and the return run 28 is less than the diameter of the impression cylinder 31 so that the impression cylinder is more or less symmetrically overlapped by each of the delivery runs. The length of the conveyor delivery loop defined by the impression cylinder, and indicated at CD in FIG. 1, is preferably equal to $NL+L/2$), where N is a low integer and L is the gripper-to-gripper spacing so that the cross members and grippers passing in the return run are idly accommodated in the groove 41 of the impression cylinder. This condition of idle accommodation is illustrated in FIG. 1*b*. In short, the successive cross members and grippers are accommodated in the groove 41 of the impression cylinder 31 in both the delivery and return directions. This results in a high degree of compactness of the assembly. The fact that the three cylinders 31, 32 and 33 are of a diameter less than the diameter of the cylinders in the regular press unit 10 similarly contributes to compactness.

Still further in accordance with the present invention, the plate cylinder 33 is offset from the blanket and impression cylinders 31, 32 in a direction downstream of the delivery run so that the plane which contains the axes of the plate and blanket cylinder intersects the plane which contains the axes of the blanket and impression cylinders at an obtuse angle which is substantially less than 180°, and means are interposed between the blanket cylinder and the frame for adjusting the blanket cylinder broadwise in a direction which substantially bisects the obtuse angle. Referring to FIG. 2 the plane which contains the axes of cylinders 31, 32 is indicated at 45, and the plane which contains the axes of the cylinders 32, 33 is indicated at 46. Thus, in carrying out the invention the plate cylinder 31 is in effect bodily swung through an angle $\beta$ in the downstream, or delivery, direction causing an angle $\alpha$ between the two planes to be substantially less than a straight angle. For the purpose of adjusting the blanket cylinder back and forth broadwise in a direction 47 which bisects the obtuse angle, an eccentric sleeve 52 is interposed between the shaft 38 and the frame of the machine, the structure being duplicated at both ends of the cylinder.

Moreover, for adjusting the plate cylinder 33 in a direction toward and away from the blanket cylinder, in the plane 46, a similar eccentric sleeve 53 is provided, again at both ends of the cylinder. The sleeves have operating handles 54, 55, respectively, causing the plate cylinder to be adjusted in the direction shown. A slight rocking movement of the sleeve 52 increases, or decreases, the impression with respect to the impression and plate cylinders. Rocking of the eccentric sleeve 53 of the plate cylinder, on the other hand, provides independent control of the impression between the plate and blanket cylinders.

Figure 3:
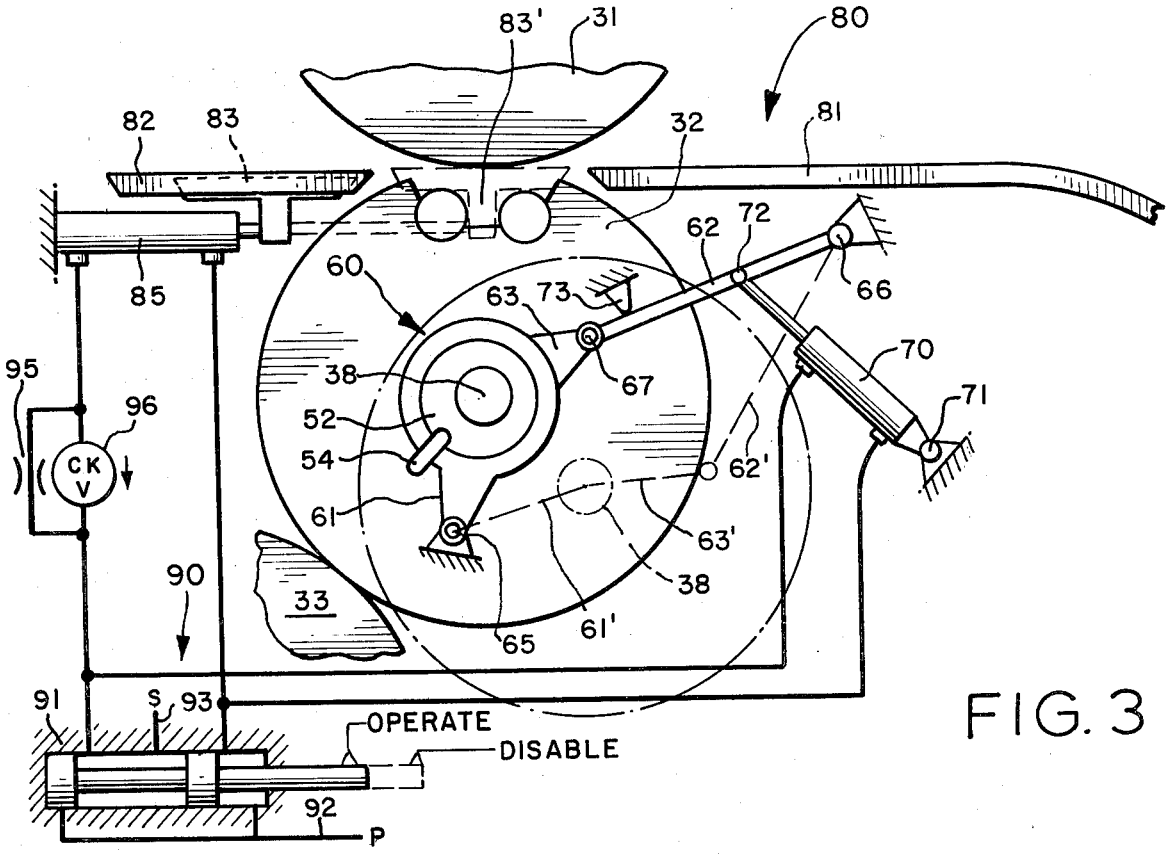
FIG. 3 is a further enlargement showing the provision for throw-off of the blanket cylinder and the simultaneous insertion of a sheet guide segment.

In accordance with one of the detailed aspects of the present invention the blanket cylinder 32 is mounted upon a swingable throw-off linkage for swinging between a working position in which the blanket cylinder is in engagement with the impression cylinder and a retracted position in which the blanket cylinder is spaced at least 20 millimeters away from the impression cylinder. The linkage in the present instance, generally indicated by the numeral 60 (FIG. 3), includes a first arm 61 which mounts the shaft 38 of the cylinder, a second, or actuating arm 62, and an intermediate link 63. The arms 61, 62 are pivoted to the frame of the machine at pivots 65, 66, respectively, while the arm 62 is connected to the link 63 by a pivot 67.

For the purpose of swinging the actuator arm 62 from its retracted position to the illustrated working position, a pneumatic or hydraulic actuator 70 is used pivoted to the frame at 71 and pinned, at 72, to the central portion of the arm 62. A limit stop, or reference stop, 73 defines the limit of movement of the arm 62 and hence the degree of extension of the actuator.

With the actuator 70 in its expanded state, the eccentric sleeve 52 is in working position but subject to rocking movement for control of impression as discussed above. When the actuator 70 is, on the other hand, contracted, the arm 62 is drawn away from the stop 73 and the elements comprising the linkage 60 retreat to the retracted positions 61', 62', 63' shown by the dotted lines in FIG. 3. Using the geometry shown, the blanket cylinder will be withdrawn from the impression cylinder by an amount which substantially exceeds 20 millimeters.

As a further feature of the invention the throw-off mechanism includes a sheet guide segment with means for interposing the segment between the blanket cylinder and the impression cylinder as the blanket cylinder is retracted, so that the sheet is held safely away from the blanket cylinder free of transfer of any ink therefrom. Thus, referring again to FIG. 3, the sheet guide 80 normally consists of two spaced sections 81, 82 having a gap between them enabling the impression and blanket cylinders 31, 32 to engage one another. In carrying out the invention a bridging segment 83 is provided mounted upon the plunger of an auxiliary actuator 85 so that the segment 83 normally occupies its retracted position but, upon extension of the actuator 85, occupies its bridging position 83' shown by the dotted outline.

The movements of the actuators 70, 85 may be coordinated by connecting them in a hydraulic circuit generally indicated at 90 having a spool valve 91 connected to a source of pressurized fluid 92 and to a sump 93. In the condition of the mechanism illustrated in FIG. 3 the actuator 70 is pressurized for extension and the actuator 85 is pressurized for retraction which is the operating state. When it is desired to retract the blanket cylinder, the spool in the valve 91 is shifted into the dotted "disable" position in which the actuator 70 is pressurized for retraction and the actuator 85 is pressurized for extension. A restriction 95 in the line leading to the actuator 85 ensures a time delay in the extension of the guide segment to permit time for the impression cylinder to get out of the way. The restriction 95 is, however, bypassed by a check valve 96 to ensure rapid retraction of the guide segment when the blanket cylinder is moving back into its operating position.

It will be apparent that the objects of the invention have been amply fulfilled. The printing cylinders in the delivery accomplish verso printing cheaply, conveniently and compactly, saving the expense of a further printing unit for printing on the back side of the sheet. When the verso printing function is not required it is a simple matter to throw the control valve 91 into its "disable" position, protection being automatically provided for the passing sheet.

The term "guide rails" as used herein refers to any means which may be used to guide the conveyor chains along predetermined delivery and return runs.

We claim:

1. An apparatus for printing the back side of a sheet being fed from a sheet-fed printing press unit into a delivery unit comprising, in combination, a frame, guide rails in the frame, a pair of conveyor chains laterally spaced from one another on the guide rails to form an endless loop conveyor extending from the press unit to a delivery pile, the chains having cross members at regular intervals, grippers at the cross members for gripping the leading edge of a sheet, the guide rails being arranged to form a delivery run and return run spaced apart and generally parallel to one another, an impression cylinder journalled in the frame between the runs in a position in which it is overlapped by each of the runs but having an axial length which is shorter than the lateral spacing between the chains, a blanket cylinder journalled in the frame outside of the delivery run and in rolling engagement with the impression cylinder, a plate cylinder having inking and dampening systems and in running engagement with the blanket cylinder, the circumference of the cylinders being equal to the spacing between the successive cross members and grippers, the impression cylinder having a longitudinal groove sufficiently large to provide free passage for the cross members and associated grippers in both the delivery and return runs, and means for driving the cylinders in synchronism with the conveyor chains so that a sheet passing on the grippers is engaged between the impression and blanket cylinders for application of a printed impression to the sheet.

2. An apparatus for printing the back side of a sheet being fed from a sheet-fed printing press unit into a delivery unit comprising, in combination, a frame, guide rails in the frame, a pair of conveyor chains laterally spaced from one another on the guide rails to form an endless loop conveyor extending from the press unit to a delivery pile, the chains having cross members at regular intervals, grippers at the cross members for gripping the leading edge of a sheet, the guide rails being arranged to form a delivery run and return run spaced apart and generally parallel to one another, an impression cylinder journalled in the frame between the runs having an axial length which is shorter than the lateral spacing between the chains, a blanket cylinder journalled in the frame outside of the delivery run in rolling engagement with the impression cylinder, a plate cylinder having inking and dampening systems and in running engagement with the blanket cylinder, the circumference of the cylinders being equal to the spacing between the successive cross members and grippers, the impression and blanket cylinders having mated longitudinal grooves sufficiently large to provide free passage for the cross members and associated grippers, means for driving the cylinders in synchronism with the conveyor chains so that a sheet passing on the grippers is engaged between the impression and blanket cylinders for application of a printed impression to the sheet.

3. The combination as claimed in claim 1 or in claim 2 in which the speed of the conveyor is less than press speed in a predetermined ratio, the cylinders being of the same diameter, which diameter is less than the diameter of the cylinders in the associated press unit in the same ratio.

4. The combination as claimed in claim 1 or in claim 2, the spacing between the delivery run and the return run being somewhat less than the diameter of the impression cylinder so that the impression cylinder is overlapped by each of the runs, the length of the conveyor delivery loop defined by the impression cylinder being equal to $NL+(L/2)$ where N is a low integer and L is the gripper-to-gripper spacing so that cross members and grippers passing in the return run are idly accommodated in the groove of the impression cylinder.

5. The combination as claimed in claim 1 or in claim 2 in which the plate cylinder is offset from the blanket and impression cylinders in a direction downstream of the delivery run so that the plane which contains the axes of the plate and blanket cylinder intersects the plane which contains the axes of the blanket and impression cylinders at an obtuse angle, and means interposed between the blanket cylinder and the frame for adjusting the blanket cylinder broadwise in a direction which substantially bisects the obtuse angle.

6. The combination as claimed in claim 1 or in claim 2 in which the blanket cylinder is mounted upon a swingable throw-off linkage including a toggle for swinging between a working position in which the blanket cylinder is in engagement with the impression cylinder with the toggle substantially on center and a retracted position in which the blanket cylinder is spaced at least 20 millimeters away from the impression cylinder.

7. The combination as claimed in claim 1 or in claim 2 in which the blanket cylinder is mounted upon a swingable throw-off linkage including a toggle for swinging between a working position in which the blanket cylinder is in engagement with the impression cylinder with the toggle substantially on center and a retracted position in which the blanket cylinder is spaced at least 20 millimeters away from the impression cylinder and which includes a sheet guide segment with means for interposing the segment between the blanket cylinder and the impression cylinder as the blanket cylinder is retracted so that the sheet is held safely away from the blanket cylinder free of transfer of any ink therefrom.

* * * * *